US006505420B1

(12) United States Patent
Litchfield et al.

(10) Patent No.: US 6,505,420 B1
(45) **Date of Patent: *Jan. 14, 2003**

(54) CUSHIONING MEMBER FOR AN ARTICLE OF FOOTWEAR

(75) Inventors: Paul E. Litchfield, Worcester, MA (US); Steven F. Smith, Taunton, MA (US); Matthew Montross, Newton, MA (US)

(73) Assignee: Reebok International Ltd., Stoughton, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/834,392

(22) Filed: Apr. 16, 1997

Related U.S. Application Data

(63) Continuation of application No. 08/599,100, filed on Feb. 9, 1996, now abandoned, which is a continuation of application No. 08/284,646, filed as application No. PCT/US94/00895 on Jan. 26, 1994, now abandoned.

(51) Int. Cl.[7] ..... H43B 5/00
(52) U.S. Cl. ..... 36/29; 36/28; 36/43
(58) Field of Search ..... 36/28, 29, 71, 36/3 R, 3 B, 43, 44, 25 R, 31, 35 R, 35 B, 37, 93, 153; 138/42

(56) References Cited

U.S. PATENT DOCUMENTS

| | | | | |
|---|---|---|---|---|
| 1,069,001 | A | 7/1913 | Guy | |
| 1,193,608 | A | 8/1916 | Poulson | |
| 1,605,985 | A | 11/1926 | Rasmussen | |
| 1,711,270 | A | 4/1929 | Litle, Jr. | 138/42 |
| 2,080,499 | A | 5/1937 | Nathansohn | |
| 2,090,881 | A | 8/1937 | Wilson | |
| 2,215,463 | A | 9/1940 | Di Mauro | |
| 2,266,476 | A | 12/1941 | Riess | |
| 2,318,206 | A | 5/1943 | Eisenlohr | 138/42 |
| 3,120,712 | A | 2/1964 | Menken | 36/29 |
| 3,225,463 | A | 12/1965 | Burnham | 36/3 B |
| 3,341,952 | A | 9/1967 | Dassler | |
| 3,402,485 | A | 9/1968 | McMorrow | |
| 3,469,576 | A | 9/1969 | Smith et al. | |
| 4,100,686 | A | 7/1978 | Sgarlato et al. | 36/29 |
| 4,183,156 | A | 1/1980 | Rudy | |
| 4,219,945 | A | 9/1980 | Rudy | 36/29 |

(List continued on next page.)

FOREIGN PATENT DOCUMENTS

| | | |
|---|---|---|
| DE | 820869 | 9/1951 |
| DE | 28 00 359 | 7/1979 |
| EP | 0095357 | 11/1983 |

(List continued on next page.)

OTHER PUBLICATIONS

Zonic brochure; date unknown.

Translation of Japanese Patent Application No. HEI 6–181802, 46 pages, Jul. 5, 1994.

(List continued on next page.)

*Primary Examiner*—M. D. Patterson
(74) *Attorney, Agent, or Firm*—Sterne, Kessler, Goldstein & Fox P.L.L.C.

(57) ABSTRACT

A cushioning member for an article of footwear is provided having a series of interconnected chambers filled with ambient or slightly pressurized air. An impedance is provided between selected chambers, in order to restrict the flow of air between the chambers. The shape and structure of the impedance determines the nature of the air flow between chambers, such that the cushioning member can be tailored for various types of activities and body weights, by offering varying degrees of cushioning.

23 Claims, 11 Drawing Sheets

U.S. PATENT DOCUMENTS

| | | | | | |
|---|---|---|---|---|---|
| 4,312,140 | A | | 1/1982 | Reber | |
| 4,358,902 | A | | 11/1982 | Cole et al. | 36/28 |
| 4,446,634 | A | | 5/1984 | Johnson et al. | 36/29 |
| 4,458,430 | A | | 7/1984 | Peterson | 36/28 |
| 4,547,978 | A | | 10/1985 | Radford | |
| 4,577,417 | A | | 3/1986 | Cole | 36/29 |
| 4,763,426 | A | | 8/1988 | Polus et al. | |
| 4,779,359 | A | | 10/1988 | Famolare, Jr. | |
| 4,799,319 | A | | 1/1989 | Zellweger | 36/29 |
| 4,817,304 | A | | 4/1989 | Parker et al. | |
| 4,845,861 | A | | 7/1989 | Moumdjian | 36/29 |
| 4,856,208 | A | | 8/1989 | Zaccaro | 36/29 |
| 4,936,030 | A | | 6/1990 | Rennex | 36/28 |
| 4,999,931 | A | | 3/1991 | Vermeulen | |
| 5,005,575 | A | | 4/1991 | Geri | |
| 5,025,575 | A | | 6/1991 | Lakic | 36/29 |
| RE34,012 | E | | 7/1992 | Cole et al. | |
| 5,131,174 | A | | 7/1992 | Drew et al. | 36/35 |
| RE34,102 | E | | 10/1992 | Cole et al. | 36/29 |
| 5,179,792 | A | | 1/1993 | Brantingham | 36/29 |
| 5,195,257 | A | | 3/1993 | Holcomb et al. | 36/28 |
| 5,230,249 | A | | 7/1993 | Sasaki et al. | 73/714 |
| 5,253,435 | A | | 10/1993 | Auger et al. | |
| 5,255,451 | A | | 10/1993 | Tong et al. | |
| 5,295,314 | A | | 3/1994 | Moumdjian | |
| 5,311,674 | A | | 5/1994 | Santiyanont et al. | |
| 5,313,717 | A | * | 5/1994 | Allen et al. | 36/29 |
| 5,335,382 | A | | 8/1994 | Huang | 36/29 |
| 5,343,639 | A | | 9/1994 | Kilgore et al. | 36/29 |
| 5,353,459 | A | | 10/1994 | Potter et al. | |
| 5,353,525 | A | | 10/1994 | Grim | 36/88 |
| 5,375,346 | A | * | 12/1994 | Cole et al. | 36/29 |
| 5,406,719 | A | * | 4/1995 | Potter | 36/29 |
| 5,416,986 | A | | 5/1995 | Cole et al. | 36/29 |
| 5,443,529 | A | | 8/1995 | Phillips | |
| 5,533,282 | A | | 7/1996 | Kataoka et al. | |
| 5,545,463 | A | | 8/1996 | Schmidt et al. | 428/178 |
| 5,572,804 | A | | 11/1996 | Skaja et al. | |
| 5,625,964 | A | | 5/1997 | Lyden et al. | |
| 5,625,965 | A | | 5/1997 | Blissett et al. | |
| 5,664,341 | A | | 9/1997 | Schmidt et al. | 36/28 |
| 5,701,687 | A | | 12/1997 | Schmidt et al. | 36/29 |
| 5,771,606 | A | | 6/1998 | Litchfield et al. | |
| 5,832,630 | A | | 11/1998 | Potter | |

FOREIGN PATENT DOCUMENTS

| | | |
|---|---|---|
| FR | 720257 | 2/1932 |
| FR | 2 614 510 | 4/1987 |
| FR | 2 663 208 | 12/1991 |
| GB | 338266 | 12/1930 |
| GB | 2039717 | 8/1980 |
| GB | 2085278 | 4/1982 |
| GB | 2 114 425 | 8/1983 |
| GB | 2 144 425 | 8/1983 |
| GB | 2201082 | 8/1998 |
| JP | 6/181802 | 7/1994 |
| WO | WO 91/16831 | 11/1991 |
| WO | WO 93/14659 | 5/1993 |
| WO | WO 93/12685 | 7/1993 |
| WO | WO 93/14659 | 8/1993 |

OTHER PUBLICATIONS

Photographs of Nike Air Force 180 shoe. Nike Air Force 180 shoes were on sale prior to Nov., 1993.

Brochure of the Nike Air Force 180 shoe. Brochure included with shoes on sale prior to Nov., 1993.

* cited by examiner

CUSHIONING MEMBER FOR AN ARTICLE OF FOOTWEAR

This application is a continuation of application Ser. No. 08/284,646, filed Oct. 14, 1994, now abandoned which is a 371 of PCT/US94/00895 filed Jan. 26, 1994.

This application is a continuation of application Ser. No. 08/599,100, filed Feb. 9, 1996, now abandoned.

BACKGROUND OF THE INVENTION

1. Field of the Invention

This invention relates generally to footwear, and more particularly to an article of footwear having a cushioning member disposed therein which provides enhanced cushioning properties to the article of footwear.

2. Description of Related Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made over the years to incorporate means into a shoe which provides improved cushioning and resiliency to the shoe. For example, attempts have been made to enhance the natural elasticity and energy return of the foot by providing shoes with soles which store energy during compression and return energy during expansion. These attempts have included using compounds such as ethylene vinyl acetate (EVA) or polyurethane (PU) to form midsoles. However, foams such as EVA tend to break down over time, thereby losing their resiliency.

Another concept practiced in the footwear industry to improve cushioning and energy return has been the use of fluid-filled devices within shoes. The basic concept of enhancing cushioning and energy return by transferring a pressurized fluid between the heel and forefoot areas of a shoe is known. U.K. Patent No. 338,266 to Rayne, U.S. Pat. No. 547,645 to Lacroix, U.S. Pat. No. 1,069,001 to Guy, U.S. Pat. No. 2,080,499 to Nathanson, and U.S. Reissue Pat. No. 34,102 to Cole, each disclose the basic concept of having cushions containing pressurized fluid disposed adjacent the heel and forefoot areas of a shoe. Each of these technologies presents its own complications. However, the overriding problem common to each of these technologies is that the cushioning means taught therein are inflated with a fluid under pressure. Each of the above-noted patents discloses a cushioning means wherein a pressurized gas is forced into the cushioning means, usually through a valve accessible from the exterior of the shoe.

There are several difficulties associated with using a pressurized fluid within a cushioning device. Most notably, it may be inconvenient and tedious to constantly adjust the pressure or introduce a fluid to the cushioning device. Moreover, it is difficult to provide a consistent pressure within the device thereby giving a consistent performance of the shoes. In addition, a cushioning device which is capable of holding pressurized gas is comparatively expensive to manufacture. Further, pressurized gas tends to escape from such a cushioning device, requiring the introduction of additional gas. Finally, a valve which is visible to the exterior of the shoe negatively affects the aesthetics of the shoe, and increases the probability of the valve being damaged when the shoe is worn.

A cushioning device which, when unloaded contains air at ambient pressure provides several benefits over similar devices containing pressurized fluid. U.S. Pat. No. 2,100,492 to Sindler and U.K. Patent Application No. 2,039,717 to Karhu-Titan both disclose the use of a cushioning device containing ambient air. However, neither of these patents provides for the transfer of air between the heel and forefoot portions of the shoe.

German Patent No. 820,869 to Weinhardt et al. and U.S. Pat. No. 4,577,417 to Cole both appear to disclose a cushioning device having heel and forefoot cavities containing ambient air. The Weinhardt et al. patent appears to disclose a pneumatic shoe warmer insert equipped with two air chambers joined by a tube. The Cole patent discloses a sole and heel structure having premolded bulges connected by a passageway, wherein air at atmospheric pressure is disposed within the sole and heel structure.

The technologies taught in these patents do not provide for more than one rate or type of air flow between the cavities. Both these patents show a cushioning device having merely a straight "tube" passageway which connects the cavities of the device. This straight "tube" structure results in the passageways providing only one rate or type of air flow between the cavities. Neither the Cole patent nor the Weinhardt et al. patent discloses a cushioning device which may be customized for different types of activities and body weights.

A similar disadvantage is present in U.S. Pat. No. 4,458,430 to Peterson. The Peterson patent describes a cushioning device having cushions disposed beneath the heel and front transverse arch of the foot. The cushions are partially or completely filled a fluid, which may be of varying viscosities. Similar to the above-noted devices, a major deficiency of the Peterson device is that the channels connecting the cushions are merely straight "tube" channels, of a uniform diameter throughout their length. As previously indicated, this structure has the disadvantage of providing only one amount or degree of cushioning, which cannot be tailored or modified to accommodate different athletic activities and body types.

Although attempts have been made to create valve means which can control or, vary the rate of fluid flow, such attempts have resulted in overly cumbersome, complex and expensive structures. U.S. Pat. No. 4,446,634 to Johnson et al. shows an article of footwear having heel and ball bladders, two conduits connecting the bladders, and valves disposed on the conduits. By rotating knobs attached to the valves, the rate of fluid flow between the bladders can be regulated. In addition to the difficulties associated with pressurized fluid, the Johnson et al. patent suffers from several other shortcomings. Most prominent among these are that the numerous parts and intricate interrelationship thereof results in a cushioning member which is expensive to manufacture, and prone to malfunction.

PCT Application No. PCT/GB91/00740 (International Publication No. WO 91/16831) to Seymour teaches valve means comprising two ribbed members formed from a stiff plastic which are disposed above and beneath a capillary tube. Because the ribbed members of the Seymour device are formed of a different material than the cushioning member thereof, the cost of manufacturing the device is increased. In addition, the ribbed members are designed to "pinch" the capillary tube closed entirely during use, which can prevent an adequate amount of fluid from reaching the forefoot container prior to forefoot strike. Further, the capillary tube of the Seymour device merely comprises a straight tube, and thus shares the inadequacies of other devices discussed herein which possess the same feature.

Accordingly, prior to the development of the present invention, there was not a shoe which incorporated a cushioning member containing ambient air, wherein the cushioning member included a communication channel having impedance means disposed therein which served to restrict the flow of air between distinct chambers. In addition, prior to the development of the present invention, there was not a shoe which taught altering the structure of the impedance means, such that differently-sized and shaped impedance means provided varying types of air flow between the chambers, and consequently provided varying degrees of cushioning. Further, those shoes which have attempted to use fluid-filled devices incorporating valve means to cushion the foot of a wearer have had such drawbacks as adding increased weight to the shoe, providing inadequate and uneven cushioning, and being inordinately complex and expensive to manufacture.

Therefore, it is an object of the present invention to provide an article of footwear having enhanced cushioning and energy-returning characteristics.

It is a further object of the present invention to provide an article of footwear having a cushioning member containing ambient or slightly pressurized air.

It is a further object of the present invention to provide an article of footwear having a cushioning member with impedance means which restricts the flow of air between chambers.

It is a further object of the present invention to provide an article of footwear having a cushioning member which is capable of providing varying amounts or degrees of cushioning.

It is a further object of the present invention to provide an article of footwear having a cushioning member which will maintain its cushioning characteristics throughout the life of the shoe.

It is a further object of the present invention to provide an article of footwear having a cushioning member surrounded by a stablizing rim and covered by a moderator which enhances the cushioning characteristics of the cushioning member.

It is a further object of the present invention to provide an article of footwear having a cushioning member which may easily be incorporated in either a left or a right shoe without modification to the member.

It is a further object of the present invention to provide an article of footwear having a cushioning member which is simple and inexpensive to manufacture.

SUMMARY OF THE INVENTION

To achieve the foregoing and other objects, and in accordance with the purposes of the present invention as embodied and broadly described herein, the article of footwear of the present invention comprises a sole and a resilient cushioning member containing air at ambient pressure disposed within the sole. The cushioning member includes a first chamber, a second chamber and a communication chamber connecting the first and second chambers. The communication chamber has an average cross-sectional area which is less than the average cross-sectional area of both the first and second chambers. Impedance means for restricting the flow of air between the first and second chambers is disposed within the communication chamber and has an average cross-sectional area less than the remainder of the communication chamber.

The sole may comprise a midsole having a cavity portion, wherein the cushioning member is disposed within the cavity portion. Alternatively, the sole may comprise an outsole having a cavity portion, wherein the cushioning member is disposed therein. The sole may also comprise an insole having a cavity portion, wherein the cushioning member is disposed therein. The article of footwear may further comprise a sockliner having a cavity portion disposed within a upper, wherein the cushioning member is disposed within the cavity portion of the sockliner.

The cushioning member may be formed of a blow-molded elastomeric material. The article of footwear may further include a moderating member disposed above the cushioning member for defusing impact forces upon the cushioning member and providing support to the foot of a wearer. The moderating member may be formed of a material having a Shore A hardness of 75–95 or Shore C hardness of 55–75. The moderating member may be integral with the sole of the article of footwear.

The sole of the present invention may further comprise a heel portion and a forefoot portion, and the first and second chambers of the cushioning member may be disposed adjacent the heel and forefoot portions of the sole, respectively. Flexure grooves may be disposed on the second chamber of the cushioning member. A partition may be disposed on one of the first and second chambers for altering the direction of the air flow within the cushioning member.

The impedance means of the present invention may be substantially hourglass-shaped, or, alternatively, may be substantially "z"-shaped, substantially "w"-shaped, or substantially "s"-shaped.

The cushioning member may further comprise an upper portion and a lower portion which are mirror images of one another, such that the cushioning member may be readily disposed in either a left shoe or a right shoe.

Alternatively, the article of footwear of the present invention comprises a sole having a heel portion, an arch portion and a forefoot portion, and a cavity portion formed within the sole extending substantially from the heel portion to the forefoot portion thereof. A non-permeable, resilient first chamber containing ambient air is disposed within the cavity portion adjacent the heel portion. A non-permeable, resilient second chamber containing ambient air is disposed within the cavity portion adjacent the forefoot portion. A non-permeable communication chamber containing ambient air is disposed within the cavity portion adjacent the arch portion, and connects the first and second chambers. Impedance means is disposed within the communication chamber and has an average cross-sectional area which is smaller than the average cross-sectional area of the remainder of the communication chamber. The impedance means restricts the flow of air between the first and second chambers and provides enhanced cushioning to the article of footwear by controlling the velocity at which the air moves between the first and second chambers.

The article of footwear may be formed of an unitary piece of blow-molded elastomeric material. The impedance means may increase the velocity and turbulence of the air as it moves between the first and second chambers. The communication chamber may be sized and shaped to provide turbulent air flow between the first and second chambers when the weight of a wearer applies downward pressure to the first chamber. Alternatively, the communication chamber may be sized and shaped to provide laminar air flow or transitional air flow between the first and second chambers when the weight of a wearer applies downward pressure to the first chamber.

Ridges may be disposed on the upper and lower surfaces of the communication chamber. The vertical distance between the upper and lower surfaces of the second chamber may be less than the vertical distance between upper and lower surfaces of the first chamber.

A moderating member may be disposed above the cavity portion for diffusing impact forces upon the cushioning member and for providing support to the foot of a wearer. The sole of the present invention may further comprise an upper surface and a lower surface, wherein the cavity portion is formed within the lower surface of the sole, and the moderating member comprises the upper surface of the sole.

Alternatively, the article of footwear of the present invention may comprise a sole and a resilient cushioning member containing pressurized air disposed within the sole. The cushioning member includes a first chamber, a second chamber. and a communication chamber connecting the first and second chambers. The communication chamber has an average cross-sectional area which is less than the average cross-sectional area of both the first and second chambers. Impedance means for restricting the flow of air between the first and second chambers is disposed within the communication chamber and has an average cross-sectional area which is less than the remainder of the communication chamber.

BRIEF DESCRIPTION OF THE DRAWINGS

The accompanying drawings, which are incorporated in and form a part of the specification, illustrate various embodiments of the present invention and, together with the description, serve to explain the principles of the invention. In the drawings.

DETAILED DESCRIPTION OF THE INVENTION

Reference will be made in detail below to the preferred embodiment of the present invention illustrated in the accompanying drawings. It should be noted that similar or identical structure is identified using identical reference numbers.

Figure 1:
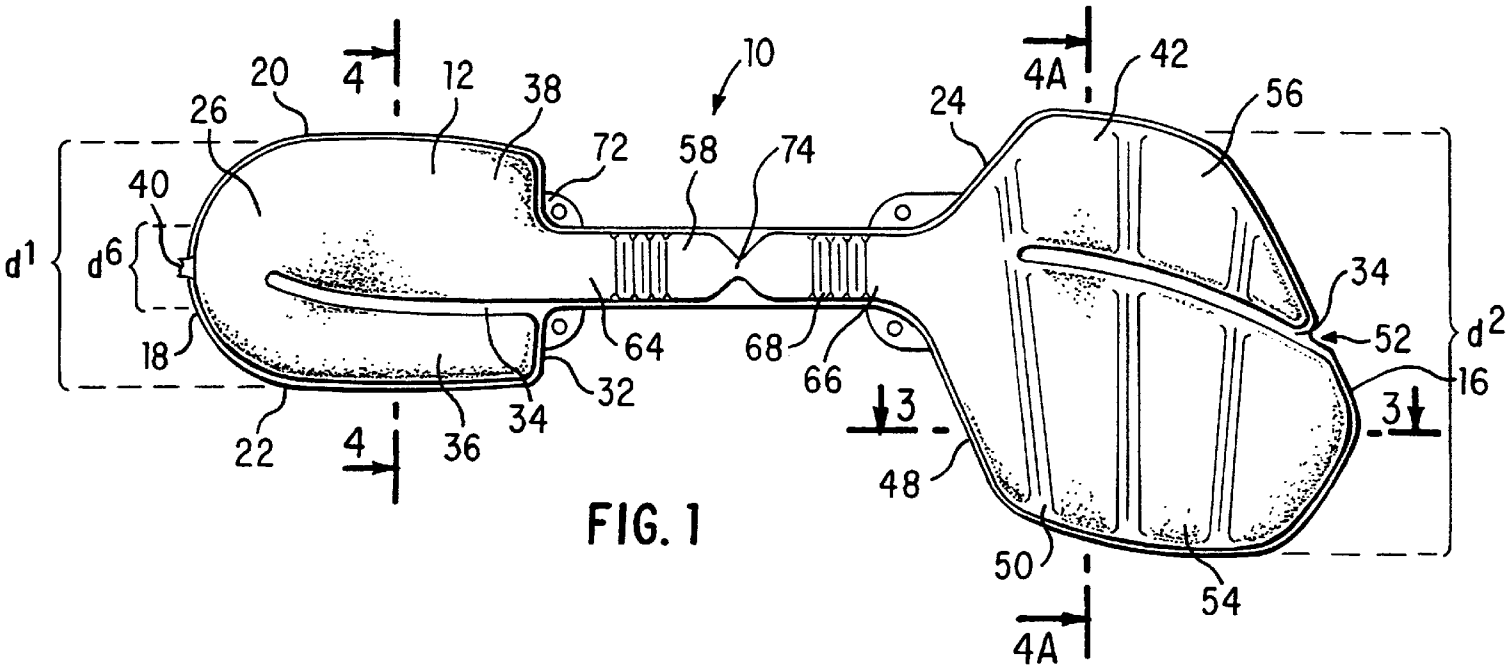
FIG. 1 is a top plan view of a cushioning member in accordance with the present invention.

Referring now to the preferred embodiments, a cushioning member in accordance with the present invention is shown generally at 10 in FIG. 1. The cushioning member provides continuously modifying cushioning to an article of footwear, such that a wearer's stride forces air within the cushioning member to move in a complementary manner with respect to the stride.

FIG. 1 is a plan view of the top of a cushioning member in accordance with the present invention. However, FIG. 1 may in fact be either a top or bottom plan view, as the top and bottom of the cushioning member 10 are substantially mirror images of one another. In light of this symmetrical construction, the cushioning member of the present invention may readily be incorporated within either a left or a right shoe. It will be appreciated that the symmetrical structure of cushioning member 10 increases the ease and reduces the expense of manufacturing cushioning member 10.

Cushioning member 10 is a three-dimensional structure including a first portion 12 and a second portion 14. First portion 12 and second portion 14 form the upper and lower surfaces of cushioning member 10. In addition, first portion 12 and second portion 14 join to form a first sidewall 20 and a second sidewall 22. Cushioning member extends transversely from first sidewall 20 to second sidewall 22, and extends forwardly from heel or rear terminus 18 to front terminus 16. First portion 12 and second portion 14 are connected along a peripheral edge 24, which results from a preferred molding process (discussed below) used to form cushioning member 10. Peripheral edge 24 helps hermetically seal cushioning member 10. Depending upon which shoe (the left or the right) cushioning member 10 is incorporated within, first portion 12 may comprise either an upper surface or a lower surface.

Cushioning member 10 is formed of a suitably resilient material so as to allow cushioning member 10 to compress and expand while also resisting breakdown. Preferably, cushioning member 10 may be formed from a host of Thermoplastic Elastomers. Suitable materials used to form cushioning member 10 may include various ranges of the following physical properties:

| | Lower Limit | Upper Limit |
|---|---|---|
| Density (Specific Gravity in g/cm$^3$) | 0.80 | 1.35 |
| Modulus @ 300% Elongation (psi) | 1,000 | 6,500 |
| Permanent Set @ 200% Strain (%) | 0 | 55 |
| Compression Set 22 hr/23° C. | 0 | 45 |
| Hardness Shore A | 70 | — |
| Shore D | 0 | 55 |
| Tear Strength (KN/m) | 60 | 600 |
| Permanent Set at Break (%) | 0 | 250 |

Many materials within the class of Thermoplastic Elastomers (TPE's) can be utilized to provide the above physical characteristics. Thermoplastic Vulcanates (such as SARLINK from PSM, SANTAPRENE from Monsanto and KRATON from Shell) are possible materials due to physical characteristics, processing and price. However, at present Thermoplastic Urethanes (TPU's) such as PELLETHANE from Dow, ESTANE from B. F. Goodrich and ELASTOLLAN from BASF (to name but a few) provide the best overall physical characteristics and consequently are the preferred choice.

The preferred method of manufacturing cushioning member 10 is via extrusion blow molding. It will be appreciated by those skilled in the art that the blow molding process is relatively simple and inexpensive. Further, each element of the cushioning member of the present invention is created during the same preferred molding process. This results in a unitary, "one-piece" cushioning member, wherein all the unique elements of the cushioning member discussed herein are accomplished using the same mold.

Cushioning member 10 is a hollow structure preferably filled with ambient air. It is important that cushioning member 10 be impermeable to air; i.e., hermetically sealed, such that it is not possible for the ambient air disposed therein to escape upon application of force to cushioning member 10. Naturally, there may be diffusion in and out of cushioning member 10. The unloaded pressure within cushioning member 10 is preferably equal to ambient pressure. Accordingly, cushioning member 10 retains its cushioning properties throughout the life of the article of footwear in which it is incorporated.

As can be seen with reference to FIG. 1, cushioning member 10 is preferably a unitary member comprising three distinct components: a first or heel chamber 26, a second or forefoot chamber 42, and a third or communication chamber 58. Heel chamber 26 is generally shaped to conform to the outline of the bottom of an individual's heel, and is disposed beneath the heel of a wearer when cushioning member 10 is incorporated within a shoe. Heel chamber 26 extends transversely from first sidewall 20 to second sidewall 22, and extends forwardly from heel terminus 18 to rear arch terminus 32. Angled transition walls 31 are disposed adjacent rear arch terminus 32 of heel chamber 26. A directional partition 34 may be disposed within heel chamber 26, and if so, serves to substantially divide heel chamber 26 into two regions: medial heel region 36 and lateral heel region 38. A sealed molding port 40 is disposed adjacent rear terminus 18, indicating the area where a molding nozzle was positioned during a preferred manufacturing process discussed above. Port 40 may easily be removed (such as by cutting or shaving) during the manufacturing process.

Disposed opposite heel chamber 26 is a second or forefoot chamber 42. Forefoot chamber 42 is generally shaped to conform to the forefoot or metatarsal area of a foot, and is disposed beneath a portion of the forefoot of a wearer when incorporated within a shoe. Forefoot chamber 42 extends transversely from first sidewall 20 to second sidewall 22, and extends rearwardly from front terminus 16 to forward arch terminus 48. Preferably, the volume of air within forefoot chamber 42 is substantially the same as the volume of air within heel chamber 26.

A small indentation or notch 52 extends inwardly from front terminus 16. Similar to heel chamber 26, forefoot chamber 42 may include a directional partition 34 which serves to substantially divide forefoot chamber 42 into two regions: medial metatarsal region 54 and lateral metatarsal region 56. A series of flexure grooves 50 extend transversely across forefoot chamber 42. Flexure grooves 50 comprise indentations or valleys formed within first surface 12 and second surface 14 of forefoot chamber 42, and facilitate the flexing or bending of forefoot chamber 42 during an individual's gait, especially during the "toe-off" phase of the gait cycle.

Disposed between heel chamber 26 and forefoot chamber 42 is a communication chamber 58. Communication chamber 58 comprises an elongated, substantially straight chamber which connects heel chamber 26 to forefoot chamber 42. Communication chamber 58 extends transversely from first sidewall 20 to second sidewall 22, and extends forwardly from a posterior region 64 adjacent rear arch terminus 32 of heel chamber 26 to an anterior region 66 adjacent forward arch terminus 48 of forefoot chamber 42.

Ridges 68 may be disposed adjacent anterior region 64 and posterior region 66 of communication chamber 58. Ridges 68 facilitate the use of cushioning member 10 within either a left or a right shoe, by allowing cushioning member 10 to flex and bend to accommodate the last bottom shape of both left and right shoes. Further, ridges 68 help prevent expansion of communication chamber 58 and increase the turbulence of air flow within cushioning member 10, as will be discussed below. Locator flanges 72 may also be disposed adjacent anterior region 64 and posterior region 66 of communication chamber 58. Locator flanges 72 can be used to assist in the placement of cushioning member 10 within an article of footwear, as will be addressed herein.

Figure 5:
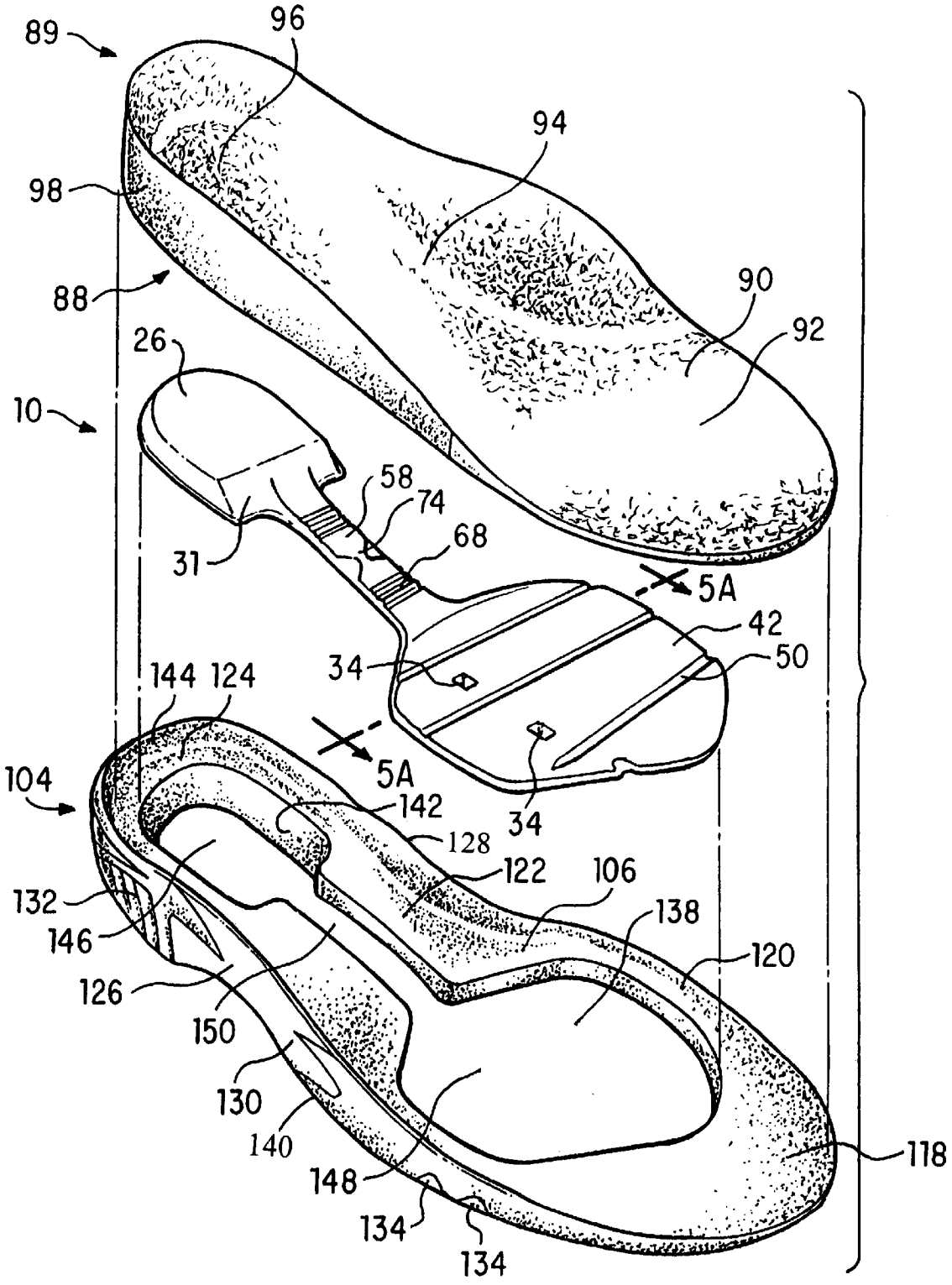
FIG. 5 is an exploded view of one possible interrelationship of a moderator, cushioning member and cradle in accordance with the present invention.
Figure 6:
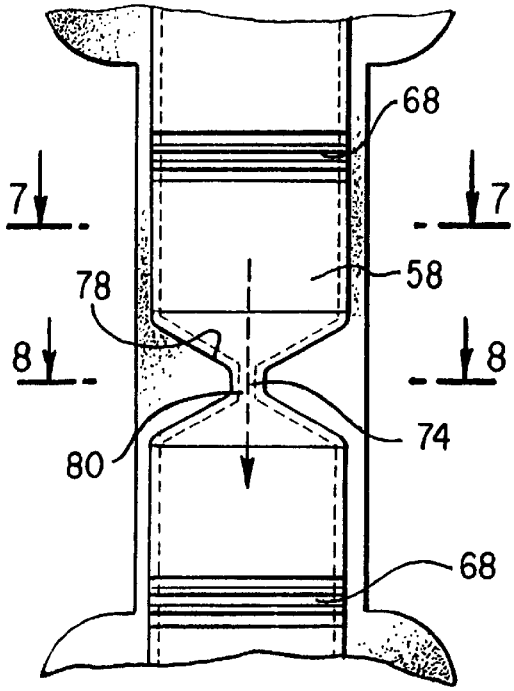
FIG. 6 is a top plan view of an impedance means in accordance with the present invention.
Figure 9:
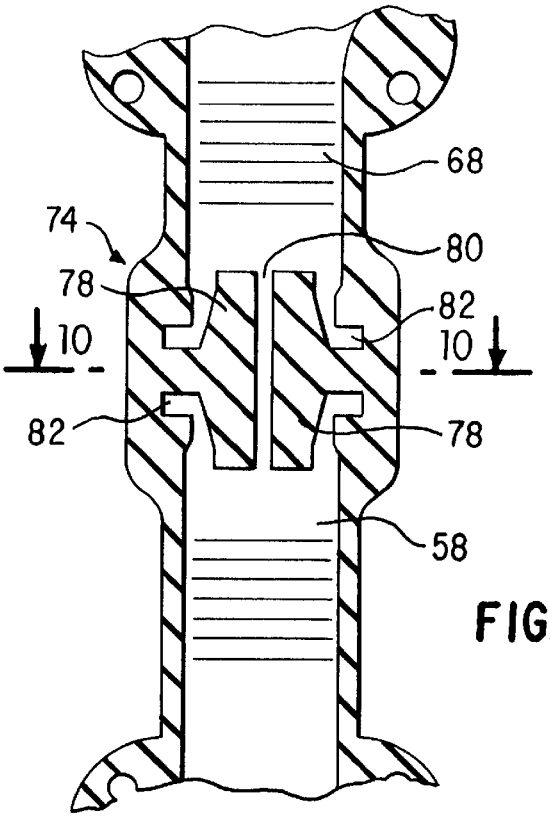
FIG. 9 is a top plan view of an alternate embodiment of impedance means in accordance with the present invention.
Figure 10:
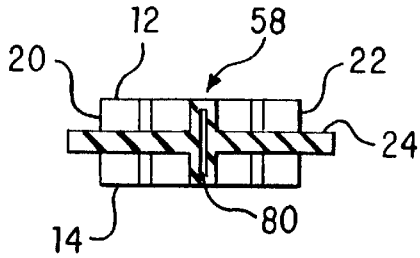
FIG. 10 is a cross-sectional view taken along line 10—10 of FIG. 9.
Figure 11:
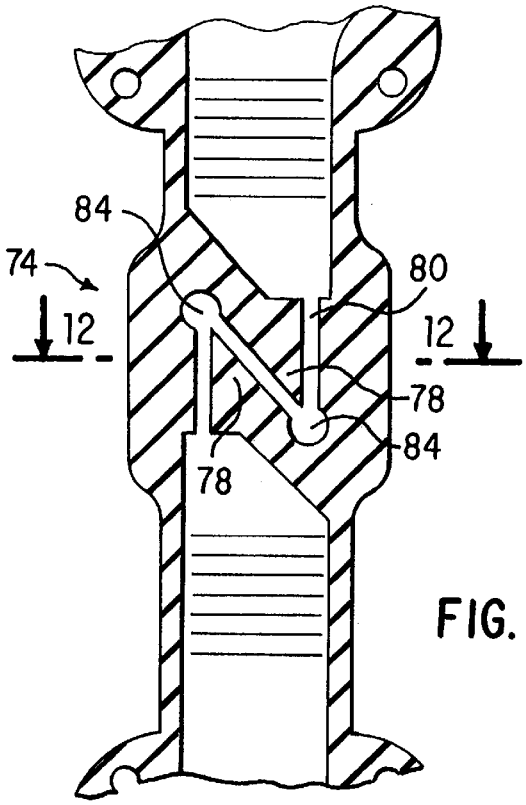
FIG. 11 is a top plan view of an alternate embodiment of impedance means in accordance with the present invention.
Figure 12:
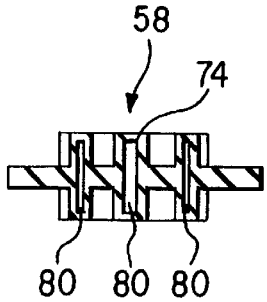
FIG. 12 is a cross-sectional view taken along line 12—12 of FIG. 11.
Figure 13:
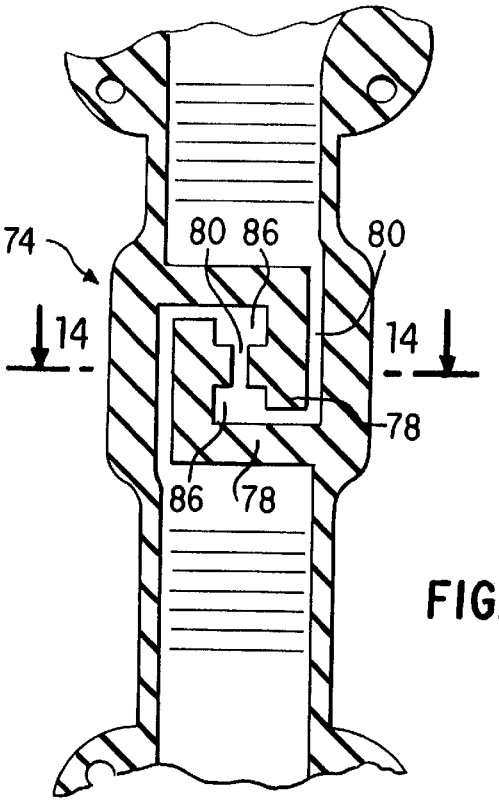
FIG. 13 is a top plan view of an alternate embodiment of impedance means in accordance with the present invention.
Figure 14:
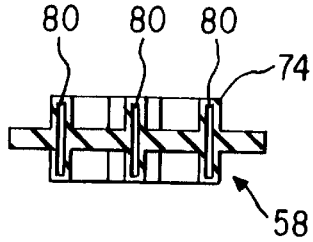
FIG. 14 is a cross-sectional view taken along line 14—14 of FIG. 13.

Central to the present invention is the inclusion of impedance means 74 within communication chamber 58. Impedance means 74 comprises a restriction or convolution in communication chamber 58 which restricts the flow of air through communication chamber 58. Essentially, impedance means 74 comprises a communication channel 80 formed and bordered by restriction walls 78. In FIGS. 1, 5 and 6, impedance means 74 is shown as being substantially "hourglass"-shaped. However, impedance means 74 may comprise numerous shapes or structures. For example, FIGS. 9–14 show some of the other forms impedance means 74 may take. FIGS. 9–10 show impedance means 74 as being substantially "w"-shaped, FIGS. 11–12 show impedance means 74 as being substantially "z"-shaped, and FIGS. 13–14 show impedance means 74 as being substantially "s"-shaped.

Impedance means 74 increases the resistance to air flow by increasing the turbulence within the air flow. The shape or structure of impedance means 74 determines the amount of air or type of air flow that is permitted to pass through communication chamber 58 at any given time. For example, of the embodiments illustrated, the "hourglass"-shaped impedance means of FIGS. 1, 5 and 6 provides the least resistance to air flow, while the "s"-shaped impedance means of FIGS. 13–14 offers the greatest resistance. Because the differently-shaped impedance means provide different types of air flow, it follows that they also provide different degrees of cushioning. That is, the structure of impedance means 74 significantly affects the degree of cushioning provided by heel chamber 26 and forefoot chamber 42 of cushioning member 10. Accordingly, different impedance means can be used to accommodate various types of athletic activities, as well as different body weights. For example, one structure of impedance means can be provided to accommodate walking gait patterns, while a different structure can be used to suit running gait patterns. This is a significant improvement over previously-known cushioning devices, which merely have straight "tubes" offering only one type or degree of cushioning.

The different structures of the impedance means of the present invention are accomplished during the preferred blow-molding manufacturing process described above. Accordingly, no complicated or expensive valve means need be attached to cushioning member 10. Rather, the shape of impedance means 74 is determined by the same mold used to form the remainder of cushioning member 10.

As noted above, the shape of impedance means 74 will affect the rate and character of air flow within cushioning member 10, in particular between heel chamber 26 and forefoot chamber 42 thereof. Essentially, there are three recognized types of air flow: "laminar," "transitional" and "turbulent" (however, at times transitional flow is ignored, and only laminar and turbulent flow are referred to). Laminar air flow moves in a smooth manner such that its velocities are free of macroscopic fluctuations. As the flow of air becomes more erratic, it enters a phase referred to as transitional flow, where the air flow acts primarily like laminar flow, with sporadic outbursts. In turbulent flow, the largely regular motion of laminar air flow is destroyed; the air flow undergoes a transition, becoming "thicker" and having random movement within the air flow; i.e., turbulence. In the chaotic phase of air flow referred to as turbulence, disturbances such as shear, impulse and viscous forces come into play.

Each of the embodiments of the present invention provide for different flow characteristics. These characteristics affect the performance of cushioning member 10. For example, if the cross-section dimensions of the "hourglass". embodiment of the impedance means (as shown in FIG. 1) are 3.17 mm×4.76 mm, the Reynold's Number of the air flow from heel chamber to forefoot chamber is approximately 1451, meaning the flow is laminar. Conversely, if the cross-sectional area of the same embodiment of impedance means is 1.5 mm×3.00 mm, the Reynold's Number has been found to be approximately 2651, meaning the flow is transitional. For purposes of the above calculations, the Reynold's Number was defined as $Re=V\rho D/\mu$ where V is the fluid velocity, $\rho$ is the fluid density, D is the equivalent diameter of the flow region, and $\mu$ is the dynamic viscosity of air. The equivalent diameter is the diameter of a circular duct having the same area as the rectangular duct used in the preferred embodiments of the invention. Several assumptions were made in doing the above-referenced calculations (such as an absence of shearing forces, and an assumption that heel strike occurs on a perfectly horizontal plane), and therefore the numbers reflected should be viewed as representations of what occurs in the system, not precise numerical solutions.

Returning now to the drawing figures, as previously indicated, cushioning member 10 is formed of a suitably resilient material so as to enable the heel and forefoot chambers 26, 42 thereof to compress and expand. While communication chamber 58 is preferably formed of the same resilient material as the two oppositely-disposed chambers adjacent its ends, communication chamber 58 is preferably constructed so as to prevent or substantially limit any compression or expansion thereof. Preferably, this is achieved in part by making communication chamber 58, and particularly impedance means 74 thereof, such that they each possess a smaller cross-sectional area than both heel chamber 26 and forefoot chamber 42.

Figure 2:
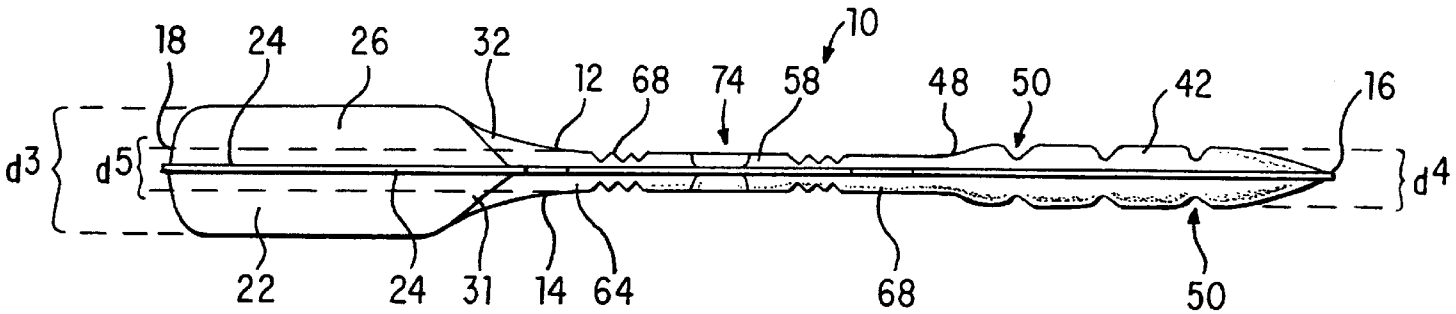
FIG. 2 is a medial side view of the cushioning member of FIG. 1.
Figure 3:
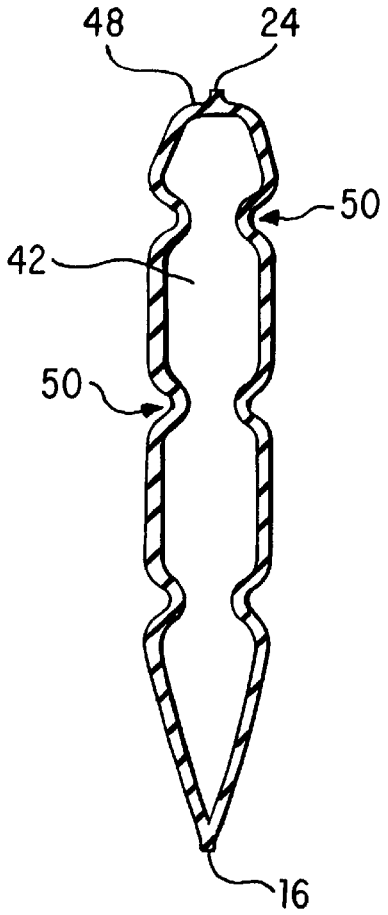
FIG. 3 is a cross-sectional view taken along line 3—3 of FIG. 1.

A comparison of various Figures reveals the differences in the cross-sectional areas of these elements. As can be seen in FIG. 1, the transverse width d6 of communication chamber 58 is less than the transverse width d1, d2 of heel chamber 26 and forefoot chamber 42. Further, the transverse width of impedance means 74 is less than the transverse width d6 of the remainder of communication chamber 58. As can be seen with reference to FIG. 2, the longitudinal height d5 of communication chamber 58 is less than the longitudinal height d3, d4 of heel chamber 26 and forefoot chamber 42. Further, the longitudinal height of impedance means 74 may be less than the longitudinal height of the remainder of communication chamber 58, although in FIG. 2 the longitudinal height of communication chamber 58 is shown as being substantially constant throughout its length.

Figure 7:
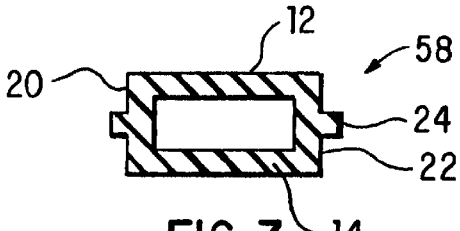
FIG. 7 is a cross-sectional view taken along line 7—7 of FIG. 6.
Figure 8:
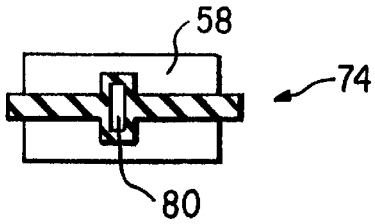
FIG. 8 is a cross-sectional view taken along line 8—8 FIG. 6.

The difference in the cross-sectional areas of the aforementioned elements is further evidenced upon reviewing FIGS. 7–14. FIG. 7 is taken along line 7—7 of FIG. 6, and shows the average cross-sectional area of communication chamber 58 apart from impedance means 74. FIGS. 8, 10, 12, and 14 clearly show that the average cross-sectional area of impedance means 74 is less than the average cross-sectional area of the remainder of communication chamber 58, regardless of the embodiment of impedance means 74 employed.

The reduced cross-sectional structure provides a rigidity to communication chamber 58 and impedance means 74 thereof that reduces any appreciable expansion or contraction of these elements. Additionally, the rigidity of communication chamber 58 may be provided by making the walls of communication chamber 58 thicker than the walls of the remainder of cushioning member 10. For example, one possible construction would be to have the walls of heel chamber 26 and forefoot chamber 42 approximately 1.5 millimeters thick, and the walls of communication chamber 58 approximately 2.5 millimeters thick.

In order to appreciate the manner in which cushioning member 10 may be incorporated within a shoe, FIG. 5 discloses one possible manner of incorporation. FIG. 5 is an exploded view showing cushioning member 10 disposed between a moderating member 88 and a rim or cradle 104. In the embodiment shown in FIG. 5, moderating member 88 comprises part of a sockliner 89, and cradle 104 comprises a midsole.

Sockliner 89 includes a foot supporting surface 90 having a forefoot region 92, an arch support region 94 and a heel region 96. A peripheral wall 98 extends upwardly from and surrounds a portion of foot supporting surface 90. Disposed on the underside of sockliner 89 is a moderating surface comprising moderator 88. Moderator 88 acts as a stiff "plate" between cushioning member 10 and the foot of a wearer. Preferably, moderator 88 is formed of material having a hardness of Shore A 75–95 or Shore C 55–75. Potential materials used to form moderator 88 include EVA, PU, polypropylene, polyethylene, PVC, PFT, fiberboard and other thermoplastics which fall within the aforementioned hardness range. The relatively stiff material acts as a moderator for foot strike, preventing the foot of a wearer from collapsing into the center portion of cushioning member 10, and diffusing impact forces evenly upon cushioning member 10, thereby reducing localized pressures. Although moderator 88 is shown in FIG. 5 as being part of a sockliner, it will be appreciated by those skilled in the art that moderator may alternatively comprise any structure that accomplishes the above-mentioned moderating function, including part of a midsole, outsole, insole, or a combination of these elements. Indeed, it is preferred that moderator 88 comprise a "plate" which is integral with cradle 104 of the present invention, as discussed below.

Figure 4:
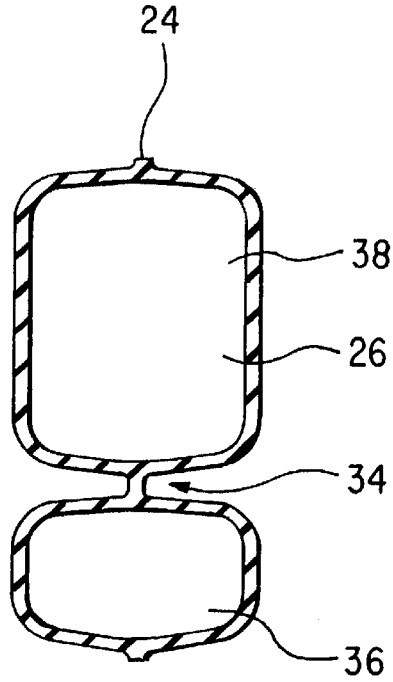
FIG. 4 is a cross-sectional view taken along line 4—4 of FIG. 1.

Disposed beneath moderator 88 in FIG. 5 is a cushioning member in accordance with the present invention. It will be noted that the cushioning member of FIG. 5 differs somewhat from that shown in FIG. 1. For example, cushioning member 10 of FIG. 5 does not include locator flanges, which are an entirely optional feature that do not directly contribute to the cushioning effect of cushioning member 10. Further, the structure of directional partition 34 in FIG. 5 differs from those of FIG. 1. In the embodiment shown in FIG. 1, directional partitions 34 essentially comprise elongated, unitary walls formed by grooves within first surface 12 and second surface 14 of both heel chamber 26 and forefoot chamber 42 (see, e.g., FIGS. 4 and 4A). Conversely, in FIG. 5, two discrete directional partitions 34 are disposed within forefoot chamber 42 only. Each directional partition 34 essentially comprises a short wall formed by small indentations within first surface 12 and second surface 14 of forefoot chamber 42 (see, e.g., FIG. 5A).

Figure 15:
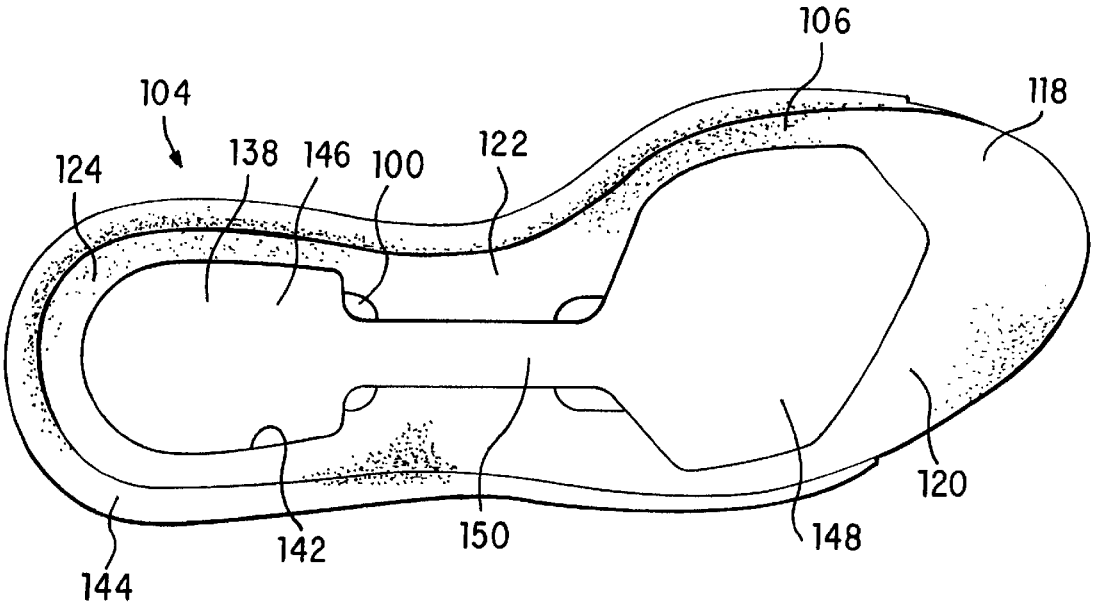
FIG. 15 is a top plan view of an alternate embodiment of a midsole in accordance with the present invention.
Figure 16:
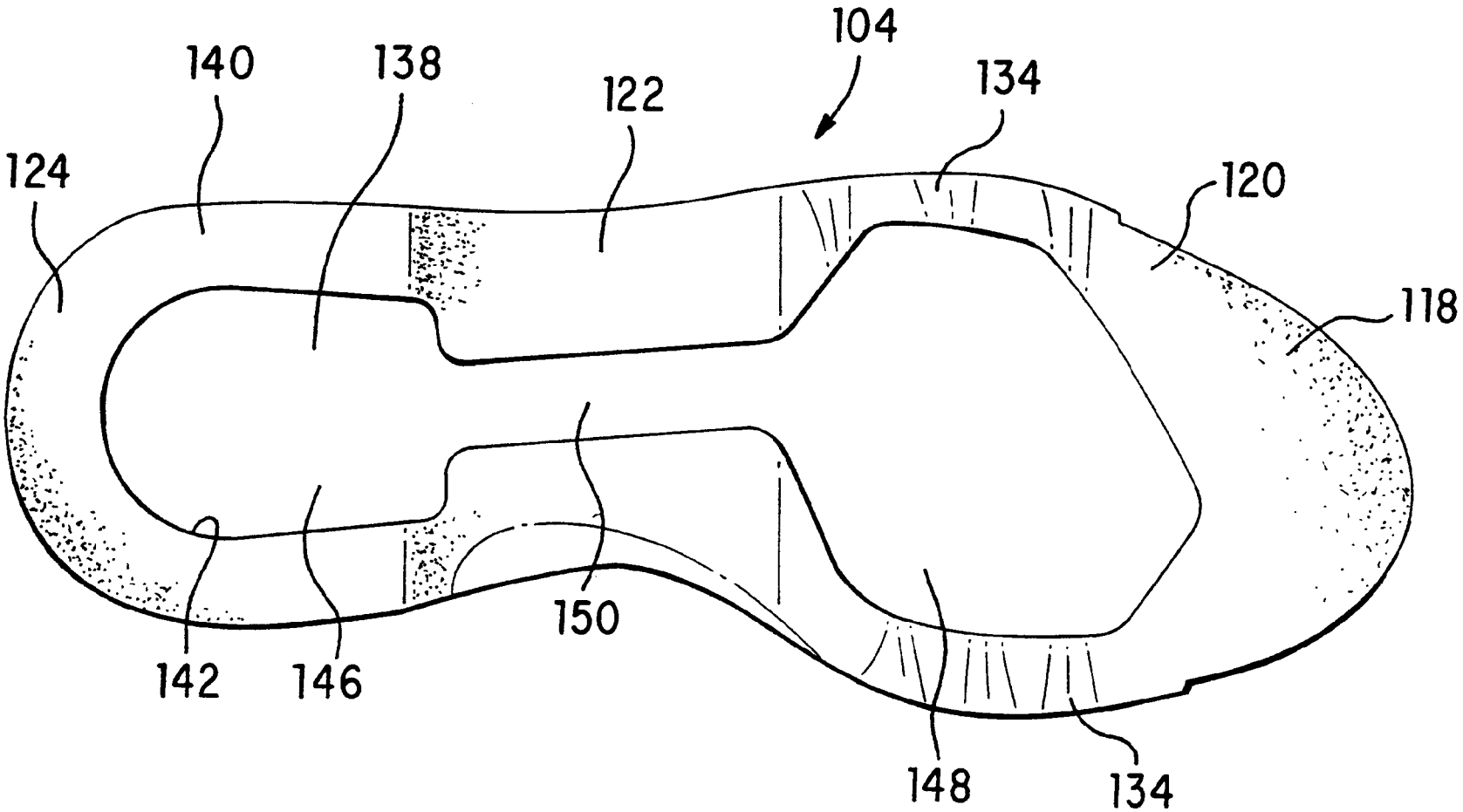
FIG. 16 is a bottom plan view of the midsole of FIG. 15.

With continuing reference to FIG. 5, disposed beneath cushioning member 10 is a cradle 104 comprising a midsole. It has been found that in order to most effectively complement a gait function, cushioning member 10 preferably comprises a core of more compliant cushioning surrounded by a midsole or similar structure that is stiffer than cushioning member 10, and creates a "cradling" effect to cushioning member 10. In FIG. 5, this cradle is shown as being a midsole. Midsole 104 has a top surface 106 including a toe portion 118, a forefoot portion 120, an arch or middle portion 122 and a rear portion 124. Locator flange receiving means 100 may be disposed on top surface of midsole 104 (see, e.g., FIG. 15). An exterior sidewall 126 extends around the medial side 128 (not shown) and lateral side 130 of midsole 104. A pattern 132 is disposed on exterior sidewall 126, as are outsole-engaging notches 134. Exterior sidewall 126 may be constructed so that cushioning member 10 is visible from the exterior of the shoe.

A cavity 138 is formed within and extends completely through midsole 104 from top surface 106 to bottom surface 140 thereof. Cavity 138 extends generally from rear portion 124 to forefoot portion 120 of midsole 104, and forms an interior sidewall 142 within midsole 104 which is substantially identical in shape to the outline of peripheral edge 24 of cushioning member 10.

A rim 144 extends upwardly from and surrounds a portion of top surface 106 of midsole 104. In the illustrated arrangement of FIG. 5, midsole 104 receives cushioning member 10 such that peripheral edge 24 of cushioning member 10 contacts interior sidewall 142 formed by cavity 138 substantially about the entire periphery thereof. When cushioning member 10 is placed within cavity 138, top surface 106 of midsole 104 is substantially flush with cushioning member 10. However, heel chamber 26 and forefoot chamber 42 preferably bulge slightly above top surface 106 of midsole 104, in order to facilitate the cushioning effect of cushioning member 10. Although in the illustrated embodiment of FIG. 5 cushioning member is disposed within a midsole, those skilled in the art will appreciate that cushioning member 10 may alternatively be disposed within a cavity formed within an outsole, an insole, or even within a shoe "upper," such as in a sockliner disposed within the upper.

In order to fully appreciate the cushioning effect of the present invention, the operation of the present invention will now be,described in detail. As previously indicated, cushioning member 10 is disposed within an article of footwear (not shown). When stationary, the foot of a wearer is adequately cushioned by cushioning member 10. When the wearer begins a stride, the heel area of the article of footwear contacts the ground or other support surface first. At this time, the weight of the wearer applies downward pressure on heel chamber 26 of cushioning member 10, causing first portion 12 of heel chamber 26 to be forced downwardly toward second portion 14 thereof. The compression of heel chamber 26 causes the air within the chamber to be forced forwardly, through communication chamber 58, into forefoot chamber 42. The velocity at which the air flows between chambers depends upon the structure of communication chamber 58, particularly the structure of impedance means 74.

As air passes through communication chamber 58, ridges 68 help increase the turbulence within the air flow. The turbulence in the air flow is further increased as the air passes through impedance means 74. As previously described, the manner in which and degree to which turbulence increases is a factor of the shape of impedance means 74. In the embodiment shown in FIGS. 1, 5, 6 and 8, the air is essentially funneled in a straight manner through the reduced cross-sectional area of impedance means 74. In the embodiment shown in FIGS. 9–10, some air is channeled straight through a narrow communication channel 80 formed and bordered by resistance walls 78, while other air is routed into diversion channels 82 formed and bordered by resistance walls 78. Those skilled in the art will appreciate that this construction creates more turbulence in the air flow than does the "hourglass" construction previously described.

In the embodiment of impedance means disclosed in FIGS. 11–14, the air flow substantially reverses direction while travelling through communication channel 80. In the embodiment of FIGS. 11–12, the turbulence in the air flow is further increased by the air passing through circular rotaries 84. In the embodiment of FIGS. 13–14, turbulence in the air flow is further increased as the air flow hits several resistance walls 78 comprising right angles, and passes through substantially rectangular ports 86. Those skilled in the art will appreciate that, of the embodiments shown in the Figures, the embodiment of FIGS. 13–14 provides the greatest resistance to air flow.

The flow of air into forefoot chamber 42 causes forefoot chamber 42 to expand, which slightly raises the forefoot or metatarsal area of the foot. It should be noted that when forefoot chamber 42 expands, the first and second portions 12, 14 thereof assume a somewhat convex shape. When the forefoot of the wearer is placed upon the ground, the expanded forefoot chamber 42 helps cushion the corresponding impact forces. As the weight of the wearer is applied to the forefoot, the downward pressure caused by the impact forces causes forefoot chamber 42 to compress, forcing the air therein to be thrust rearwardly through communication chamber 58 into heel chamber 26. Once again, the velocity at which the air flows from forefoot chamber 42 to heel chamber 26 will be determined by the structure of impedance means 74. After "toe-off," no downward pressure is being applied to the article of footwear, so the air within cushioning member 10 should return to its normal state. Upon the next heel strike, the process is repeated.

In light of the foregoing, it will be understood that the cushioning member of the present invention provides a variable, non-static cushioning, in that the flow of air within cushioning member 10 complements the natural biodynamics of an individual's gait.

Because the "heel strike" phase of a stride or gait usually causes greater impact forces than the "toe-off" phase thereof, it is anticipated that the air will flow more quickly from heel chamber 26 to forefoot chamber 42 than from forefoot chamber 42 to heel chamber 26. Similarly, impact forces are usually greater during running than walking. Therefore, it is anticipated that the air flow will be more rapid and more turbulent between the chambers during running than during walking.

The foregoing description of the preferred embodiment has been presented for purposes of illustration and description. It is not intended to be exhaustive or to limit the invention to the precise form disclosed, and obviously many modifications and variations are possible in light of the above teachings. For example, it is not necessary that the cushioning member, especially the heel, forefoot and communication chambers thereof, be shaped as shown in the drawings. Chambers of other shapes may function equally as well. One modification would be to construct the sidewalls of the heel and forefoot chambers so as to comprise bellows, to further facilitate the downward flexing of the chambers. In addition, there need not be, specific forefoot, heel and communication chambers. For example, all three chambers may be disposed only in the forefoot area, and the impedance means would control the air flow between the two oppositely disposed forefoot chambers.

With reference to FIGS. 1 and 5, it will be appreciated that cushioning member 10 comprises an insert which may be positioned within different areas of an article of footwear. Accordingly, although cushioning member 10 is shown as being positioned within a midsole in FIG. 5, it is to be understood that cushioning member 10 may readily be positioned within a cavity formed within an outsole, an insole, or within a sockliner disposed within the upper. When positioned within an outsole, cushioning member 10 may be visible from the exterior of the shoe. Further, because cushioning member 10 comprises an insert, it will be appreciated that the shoe in which it is incorporated may be constructed so that cushioning member 10 is readily removable and may easily be replaced with another cushioning member. Accordingly, different cushioning members can be inserted depending upon the physical characteristics of the individual and/or the type of activity for which. the shoe is intended.

Figure 17:
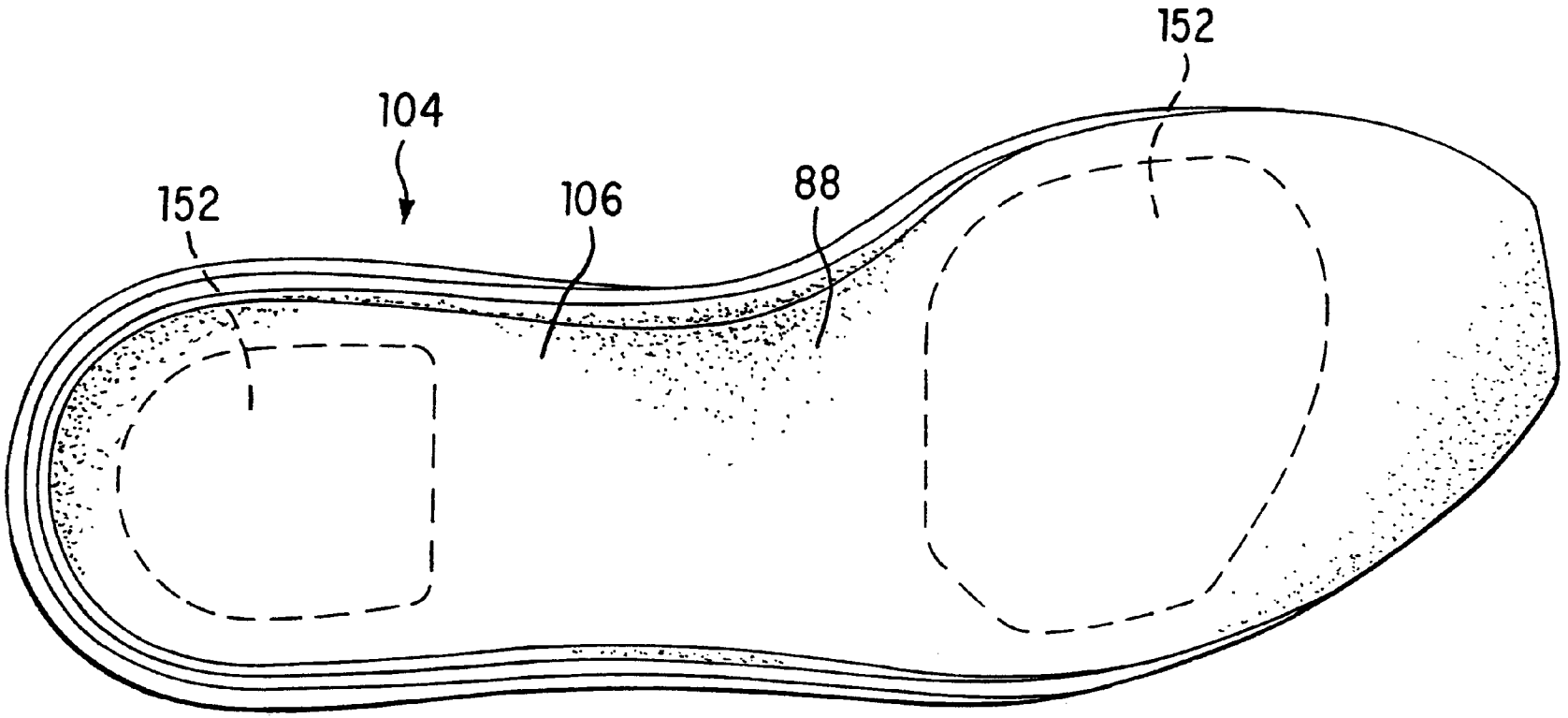
FIG. 17 is a top plan view of an integrated moderator and midsole in accordance with the present invention.
Figure 18:
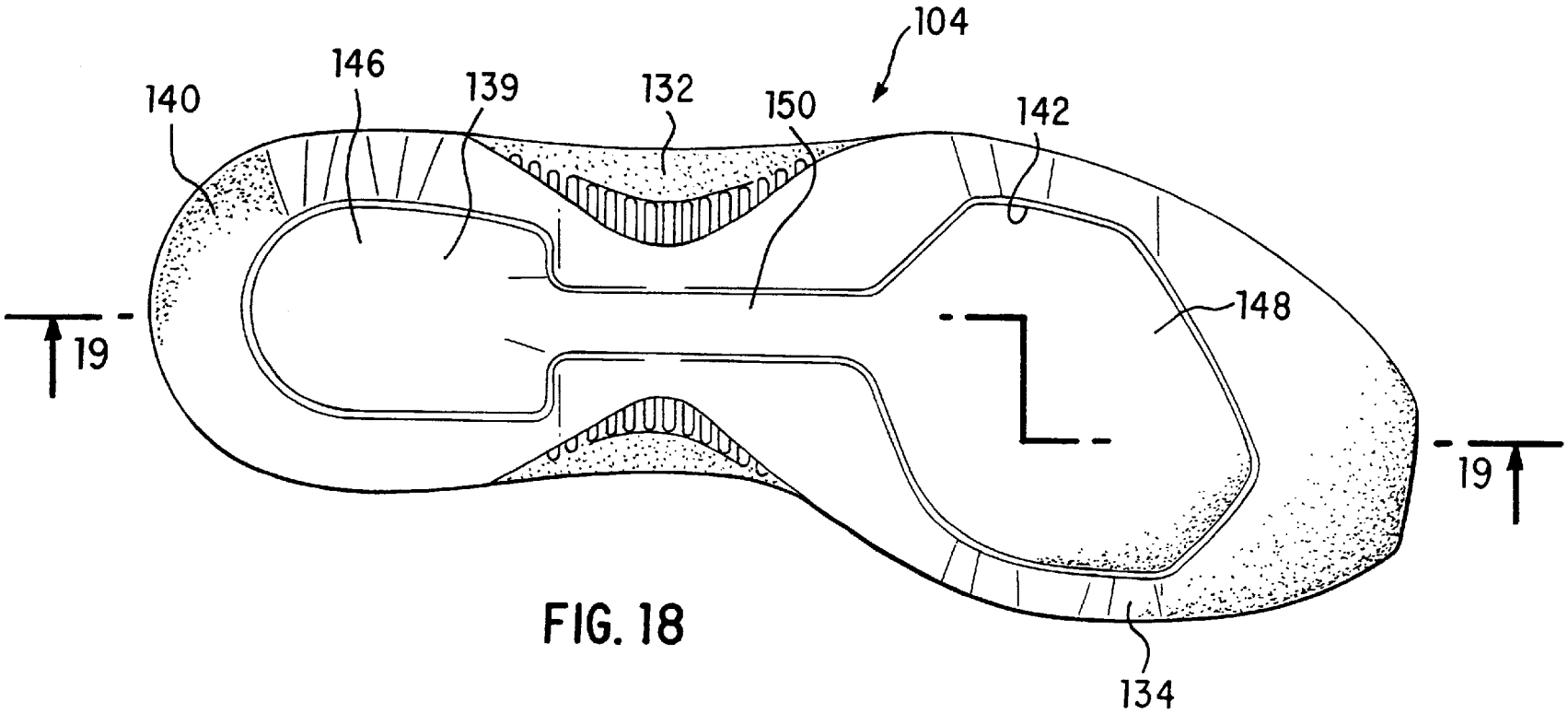
FIG. 18 is a bottom plan view of the integrated moderator and midsole of FIG. 17.
Figure 19:
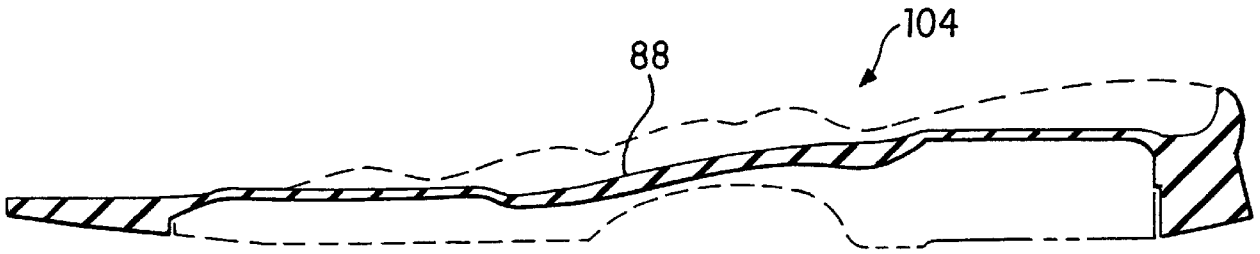
FIG. 19 is a sectional view taken along line 19—19 of FIG. 18

Further, although FIG. 5 shows moderator 88 as comprising part of a sockliner, moderator 88 may comprise any structure that results in a relatively stiff "plate" disposed above cushioning member 10. In fact, it is preferred that moderator 88 and cradle 104 be integral or unitary with one another. FIGS. 17–19 show one possible construction of this embodiment. In FIGS. 17–19, moderator 88 is shown as being integral with or comprising top surface 106 of cradle or midsole 104. In this regard, rather than having a complete cavity formed within midsole 104, moderator 88 serves to form a partial cavity or reservoir 139 within the bottom surface 140 of midsole 104. Moderator 88 further serves to create slightly raised areas 152 within top surface 106 of midsole 104 adjacent the forefoot and heel areas thereof. Partial cavity or reservoir 139 comprises a first or heel chamber receiving area 146, a second or forefoot chamber receiving area 148, and a third or communication chamber receiving area 150. Reservoir 139 receives cushioning member 10 of the present invention. Similar to complete cavity 138, partial cavity or reservoir 139 forms an interior sidewall 142 within midsole 104. In this embodiment, it is preferred that the top surface of the outsole of the article of footwear also include a small indentation or cavity for receiving communication chamber 58. It will be appreciated that the preferred integral moderator and cradle is relatively simple to manufacture, and increases the simplicity of the present invention by eliminating the need for a sockliner or other separate moderating means.

Figure 4A:
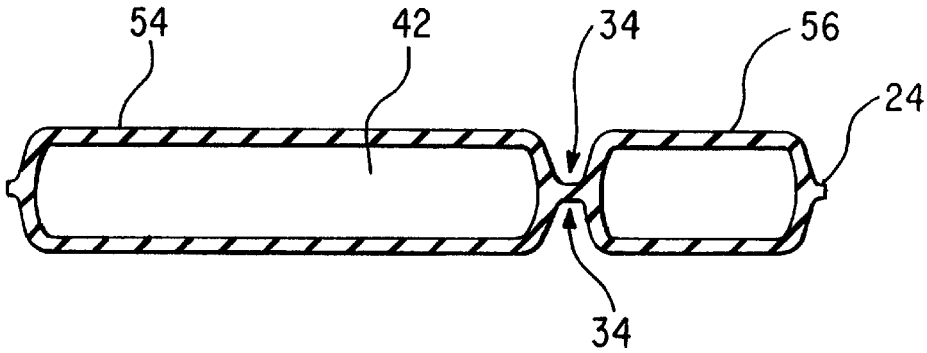
FIG. 4A is a cross-sectional view taken along line 4—4A of FIG. 1.
Figure 5A:
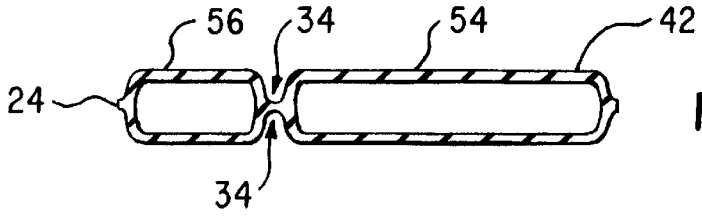
FIG. 5A is a cross-sectional view taken along line 5A—5A of FIG. 5.

As previously indicated, directional partitions 34 may be incorporated within cushioning member 10, although they need not be. If incorporated, directional partitions 34 can help compensate for the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." Directional partitions 34 can be incorporated within cushioning member 10 to ensure that the air flow within cushioning member 10 complements such a gait cycle. Referring to FIGS. 1, 4A and 5A, it has been previously noted that directional partition 34 within forefoot chamber 42 essentially divides the chamber into two regions: medial metatarsal region 54 and outer metatarsal region 56. When air is forced into forefoot chamber 42, directional partition 34 directs the majority of the air into medial metatarsal region 54, the region where the most impact forces will occur. Similarly, when air is forced into heel chamber 26, directional partition 34 formed therein ensures that the air will enter lateral heel region 38 first, as that is the region which will receive the greatest impact forces during heel strike.

Figure 20:
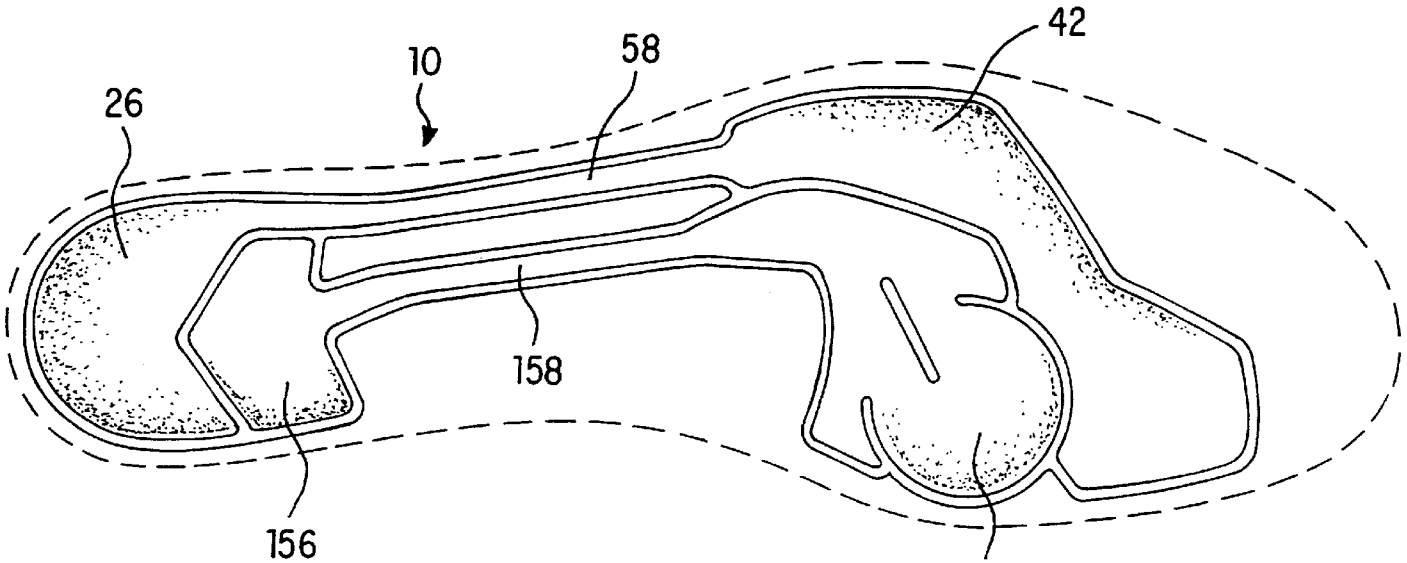
FIG. 20 is a top plan view of an alternate embodiment of a cushioning member in accordance with the present invention.
Figure 21:
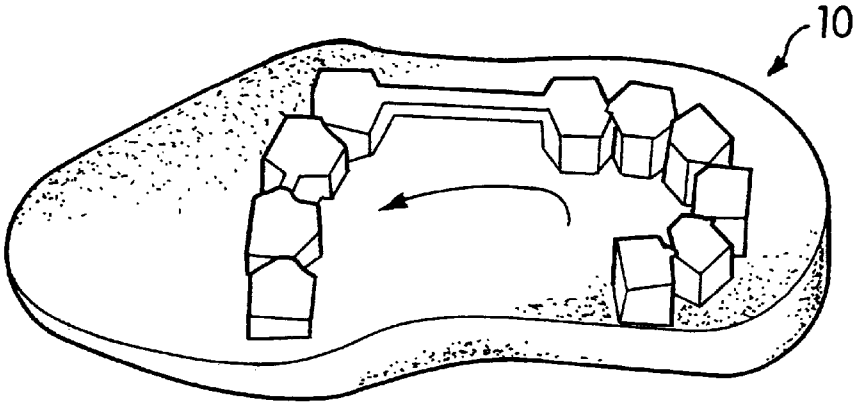
FIG. 21 is a perspective view of an alternate embodiment of a cushioning member in accordance with the present invention.

In addition to the above-noted changes, it will be readily appreciated that the number of chambers of cushioning member 10 may also be varied. For example, a second forefoot chamber 154, second heel chamber 156 and second communication chamber 158 may be provided, such as disclosed in FIG. 20, such that cushioning member 10 has two cushioning systems which function independently of one another. Alternatively, numerous, interconnected cushioning chambers may be provided, such as shown in FIG. 21. In the embodiment of FIG. 21, cushioning member 10 would provide "multistage" cushioning, wherein the different chambers would compress in sequence through the gait cycle.

Figure 22:
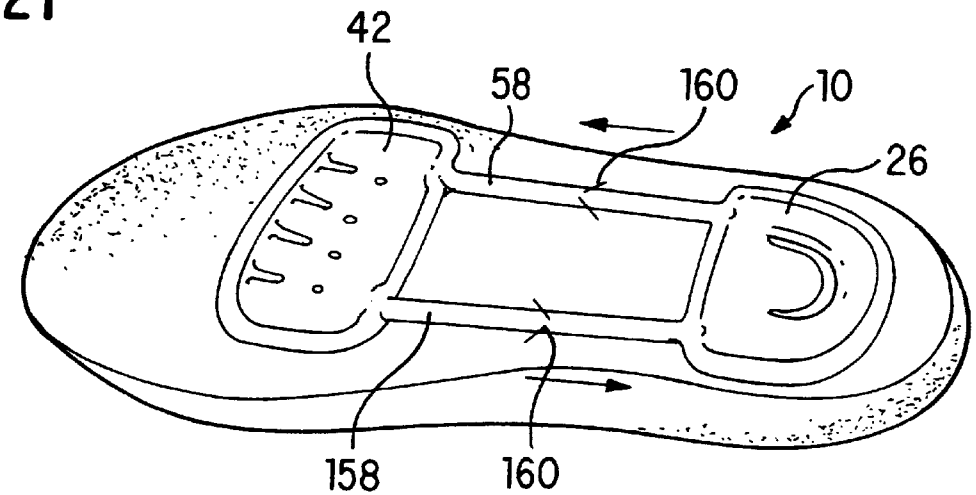
FIG. 22 is a perspective view of an alternate embodiment of a cushioning member in accordance with the present invention.

An alternative embodiment would include valve means disposed adjacent communication chamber 58, in order to allow the flow rate to be adjusted. Another embodiment, shown in FIG. 21, would be to provide cushioning member 10 with at least two communication chambers, with each chamber including an interior check-valve 160. Check valves 160 could simply comprise clamping means formed within communication chambers. In such a construction, each communication chamber would be a one-way chamber such that air could only flow in one direction therethrough. FIG. 22 shows such an embodiment, wherein fluid flows from heel chamber 26 to forefoot chamber 42 through first communication chamber 58, and from forefoot chamber 42 to heel chamber 26 via second communication chamber 158. The air flow in this embodiment could thus be directed such that it mimics the typical gait cycle discussed above. Further, one of the communication chambers could include impedance means which provides laminar air flow, while the other communication chamber could include impedance means to provide turbulent air flow.

Although three differently-shaped impedance means are shown in the accompanying drawings, other shapes will also serve to provide support and cushioning to the cushioning member of the present invention. The shape of impedance means 74 will directly affect the velocity of the air as it travels within cushioning member 10, and will therefore also affect the Reynold's Number of the air flow within cushioning member 10. As previously alluded to, the Reynold's Number, based on Reynold's Transport Theorem, is a tool which is used to determine which phase or type of air flow is present in a specified system. The Reynold's Number is a unitless number which allows one to understand which phase of air flow is present in a system, by comparing the "value" of the air flow to a predetermined number. For a smooth pipe, it is widely accepted that air flow having a Reynold's Number below 2100 constitutes laminar flow, where the Reynold's Number is defined by $$Re = \frac{V\rho D}{\mu}.$$

Air flow having a Reynold's Number between 2100 and 4000 is generally considered transitional flow, and anything over 4000 is considered to be turbulent flow.

The mass flowrate of air within the cushioning member of the present invention is dependent upon the velocity of the heel strike (in the case of air travelling from the heel chamber to the forefoot chamber). Further, the size and structure of the impedance means of the present invention directly affects the impulse forces, exerted by the air moving within the chambers of the cushioning member. With a given flowrate, the size and structure of the impedance means will dramatically affect the velocity of the air as it travels through the impedance means. Specifically, as the cross-sectional area of the impedance means becomes smaller, the velocity of the air flow becomes greater, as do the impulse forces felt in the forefoot and heel chambers.

As discussed herein, in the preferred embodiment of the present invention, ambient air is disposed within cushioning member 10. However, in an alternate embodiment of the present invention, pressurized air may be disposed within cushioning member 10. For example, in order to keep forefoot and heel. chambers 42,26 slightly convex, a slight pressure (approximately 1–4 psi) may be introduced in to cushioning member 10 when sealing the member closed. Further, it will be appreciated that other fluid mediums, including liquids and large molecule gasses, may be disposed within cushioning member 10 and provide the desired support and cushioning thereto. If a fluid medium other than ambient air is used, the structure of the impedance means may be modified in order to effectively provide the character of fluid flow desired.

It is anticipated that the preferred embodiment of the cushioning member of the present invention will find its greatest utility in athletic shoes (i.e., those designed for walking, hiking, running, aerobics, basketball and other athletic activities). However, the cushioning member is also suited to provide enhanced cushioning when incorporated within other types of footwear, including formal "dress" shoes.

The preferred embodiment was chosen and described in order to best explain the principles of the present invention and its practical application to thereby enable others skilled in the art to best utilize the invention in various embodiments and with various modifications as are suited for the particular use contemplated. It is intended that the scope of the invention be defined by the claims appended hereto.

What is claimed is:

1. An article of footwear comprising:

a sole having a top surface, a bottom surface, a medial side, a lateral side, and an exterior sidewall extending substantially around said medial side and lateral side;

a cavity formed within said sole;

a molded, sealed cushioning member disposed within said cavity formed of an elastomeric material defining a hollow interior having sufficient volume to provide cushioning upon application of a force, said hollow interior of said cushioning member containing air at substantially ambient pressure when in an unloaded condition, said cushioning member including a first chamber having an upper surface, a lower surface, a lateral side surface and a medial side surface, a second chamber having an upper surface, a lower surface, a lateral side surface and a medial side surface, and a communication chamber connecting said first chamber and said second chamber; and a plurality of ridges disposed on said upper surface and said lower surface of said communication chamber.

2. The article of footwear of claim 1, wherein said sole comprises a midsole.

3. The article of footwear of claim 1, wherein said sole comprises an outsole.

4. The article of footwear of claim 1, wherein said sole comprises an insole.

5. The article of footwear of claim 1, wherein said sole comprises a sockliner.

6. The article of footwear of claim 1, further comprising impedance means disposed within said communication chamber for restricting the flow of air between said first chamber and said second chamber.

7. The article of footwear of claim 1, wherein said sole further comprises a heel portion and a forefoot portion, and wherein said first chamber and said second chamber are disposed adjacent said heel portion and said forefoot portion, respectively.

8. The article of footwear of claim 1, further comprising flexure grooves disposed on one of said first and second chambers.

9. The article of footwear of claim 1, further comprising a partition disposed within one of said first and second chambers for altering the direction of the air flow within said cushioning member.

10. The article of footwear of claim 6, wherein said impedance means is substantially hourglass-shaped.

11. The article of footwear of claim 6, wherein said impedance means is substantially "z"-shaped.

12. The article of footwear of claim 6, wherein said impedance means is substantially "w"-shaped.

13. The article of footwear of claim 6, wherein said impedance means is substantially "s"-shaped.

14. The article of footwear of claim 1, wherein said cushioning member further comprises an upper portion and a lower portion, said upper portion and said lower portion being mirror images of one another, such that said cushioning member may be readily disposed in either a left shoe or a right shoe.

15. The article of footwear of claim 7, wherein the vertical distance between said upper surface and said lower surface of said second chamber is less than the vertical distance between said upper surface and said lower surface of said first chamber.

16. The article of footwear of claim 1, further comprising a moderating member disposed above said cavity portion for diffusing impact forces upon said cushioning member and providing support to a foot of a wearer.

17. The article of footwear of claim 16, wherein said sole further comprises an upper surface and a lower surface, said cavity is formed within said lower surface of said sole, and said moderating member comprises said upper surface of said sole.

18. The article of footwear of claim 6, wherein said impedance means comprises a communication channel formed and bordered by resistance walls.

19. The article of footwear of claim 6, wherein said communication chamber includes a lateral side surface and medial side surface defining a transverse width, and said impedance means narrows said transverse width of said communication chamber.

20. The article of footwear of claim 6, wherein said impedance means has an average cross-sectional area which is less than the average cross-sectional area of the remainder of said communication chamber.

21. The article of footwear of claim 6, wherein said upper surface of said first chamber, said upper surface of said second chamber, said upper surface of said communication chamber and said upper surface of said impedance means are formed of a unitary piece of elastomeric material.

22. The article of footwear of claim 6, wherein said first chamber, said second chamber, said communication chamber and said impedance means are formed of a unitary piece of material.

23. The article of footwear of claim 1, wherein said lateral side surfaces and said medial side surfaces of said first and second chambers are substantially vertical.

* * * * *